United States Patent [19]

Fleissner

[11] Patent Number: 4,823,730

[45] Date of Patent: Apr. 25, 1989

[54] APPARATUS FOR FINISHING ENDLESS MATERIAL WITH A PADDING DEVICE

[75] Inventor: Heinz Fleissner, Riehn/Basel, Switzerland

[73] Assignee: Vepa Aktiengesellschaft, Basel, Switzerland

[21] Appl. No.: 598,462

[22] Filed: Apr. 9, 1984

[30] Foreign Application Priority Data

Apr. 18, 1983 [DE] Fed. Rep. of Germany ..... 3313991

[51] Int. Cl.[4] ..... B05C 1/08; D06B 1/14

[52] U.S. Cl. ..... 118/223; 28/178; 68/200; 118/234

[58] Field of Search ..... 68/202; 118/223, 234, 118/246, 255; 28/178

[56] References Cited

U.S. PATENT DOCUMENTS

| | | | |
|---|---|---|---|
| 2,199,228 | 4/1940 | Obenshain et al. | 118/246 X |
| 3,621,780 | 11/1971 | Tillotson | 118/223 X |
| 3,993,805 | 11/1976 | Roberts | 118/223 X |
| 4,365,583 | 12/1982 | Hisashi et al. | 118/223 X |

*Primary Examiner*—Philip R. Coe

*Attorney, Agent, or Firm*—Antonelli, Terry & Wands

[57] ABSTRACT

The apparatus is used for wetting synthetic fiber tows with finishing liquid. For this purpose, the apparatus consists of two superimposed guide rolls over which the tow is guided in a meander-like manner. Padding devices are arranged on both sides of the tow between the guide rollers, the padding rollers of these devices act to transfer the finishing liquid from a bath located immediately thereunder continuously onto the two fed tangentially thereto.

5 Claims, 1 Drawing Sheet

APPARATUS FOR FINISHING ENDLESS MATERIAL WITH A PADDING DEVICE

Figure 2:
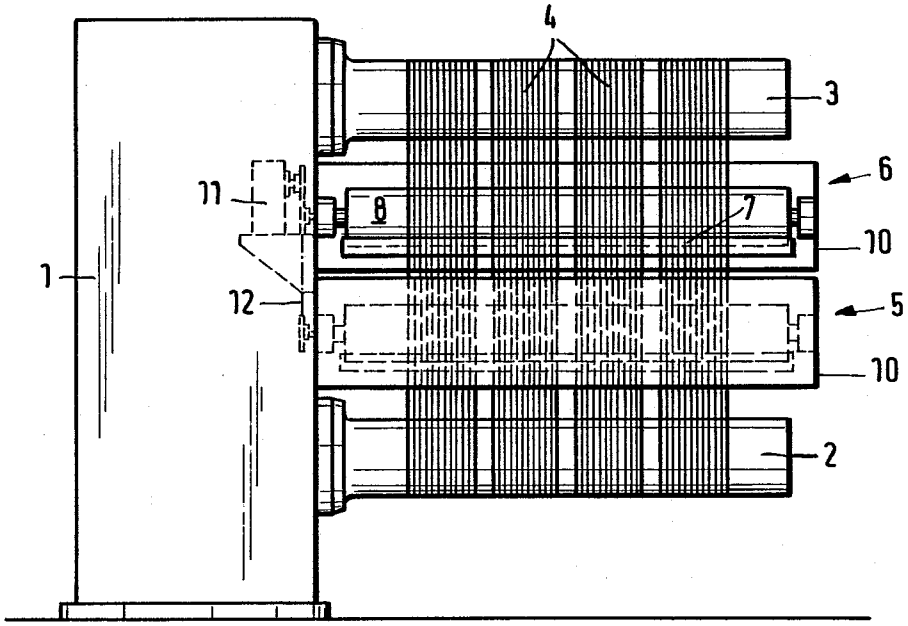

This invention relates to an apparatus for finishing endless material which includes a padding device, consisting of a rotatably supported padding roller or kiss roller immersed in a bath for transferring the finishing fluid during its revolution onto the endless material in contact with the padding roller.

Padding devices for application of treatment fluids are conventional. On example in this connection is the application of sizing liquids to lengths of textile material. The advantage of padding devices resides in the application of exactly definable quantities of liquid to the endless material. Apart from padding devices, a large number of other applicators of treatment fluids to endless material has become known. In this connection, worth mentioning is the unilateral spraying of synthetic fiber tows with finishing liquid, or also the dipping method, this finishing operation being required as a preparatory step for the subsequent further processing of the synthetic fibers.

Under practical conditions, it has been found that the unilateral or bilateral spraying of synthetic fiber tows with finishing fluid is unsatisfactory for an adequate and, in particular, uniform wetting action.

Dipping of the tows into a bath does not result in the desired objective either, since, on the one hand, the applied amount cannot be controlled and, on the other hand, finishing liquid is entrained from the bath at the production speeds nowadays customary.

Therefore, this invention is based on the object of developing an apparatus by means of which any length of synthetic material; e.g., a fiber tow, can be provided uniformly with an exactly definable quantity of finishing fluid that remains always the same per unit length and also for the purpose that the tows that may thereafter be laid on top of one another; i.e., the tow parcel, is or are penetrated by the finishing fluid uniformly over the cross section.

Starting with the apparatus of the type heretofore described, the invention, to solve the posed problem, resides in that an apparatus is also designed for synthetic fiber tows, for which purpose a padding device is arranged on both sides of such a tow. The essential advantage of this apparatus resides in that the synthetic fibers are wetted on both sides directly, in succession, with the finishing fluid; namely, without any liquid having to be lost during application, and simultaneously ensuring an intensive, uniform wetting of the fibers which is definitely controllable in a minimum quantity exactly over a unit surface.

It is advantageous for the finishing of synthetic fiber tows to arrange the padding devices in superimposed relationship, and to associate the padding rollers with the left as well as right areas displayed by a tow guided in the stretched condition. In order to make this possible, the padding devices should be provided at a frame or stand; on this frame are arranged, for the meander-like guidance of the tow, at the bottom and at the top, respectively, one guide roller that is driven, if possible, and between these guide rollers, the two padding devices are then arranged—each on an opposite side of the endless tow. In this way, the tow can be extended vertically during the finishing step resulting in uniform application of finishing fluid to both sides of the tow. Furthermore, the tow is guided in tensioned condition immediately before and after the individual padding devices so that with an only slight contact of the padding rollers a desired amount of finishing fluid can be transferred to the tow.

Advantageously, the padding rollers are designed to have such a width that several tows, which may later on have to be placed at least partially in superimposed relationship, can contact the padding rollers side-by-side at the same time. If, now, these tows are superimposed after having been guided at the subsequent guide roller by means of a tow gathering device to be separately provided for this purpose, then this feature results in a uniform distribution of the finishing medium over the cross section of the tow parcel which now is thicker.

The two padding rollers for the front and rear sides of the tow should be connected to each other by way of a drive mechanism common to both of them, and should revolve in a driven fashion in the tow transport direction. In this way, uniform application of finishing liquid to both sides of the tow is ensured. Additionally, it is especially advantageous in the apparatus of this invention to control the driving speed of the padding rollers in dependence on the tow velocity. This is advantageous insofar as always the same applied quantity of finishing liquid per unit length is ensured, no matter the velocity at which the synthetic fiber tows are fed to the padding device. The quantity of finishing liquid applied is, thus, always proportional to the tow speed and, therefore, always the same over a defined length. A change in velocity is required, for example, during startup of the apparatus or after an interruption or in case of any other operational variation in production speed. These conditions can be met in a simple way by measuring the velocity of the tow at the unit arranged upstream in the treatment line, and transmitting same to the DC motor necessary for driving the padding rollers. Additionally, a positive or negative velocity can be superimposed on the DC motor for driving the padding rollers, so that any velocity ratio of padding roller to the tow velocity ratio of padding roller to the tow velocity can be set.

Figure 1:
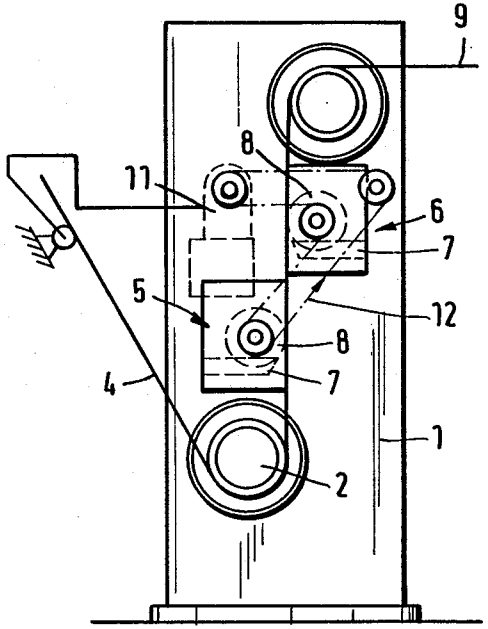

The drawings illustrate one embodiment of the apparatus according to the invention, wherein:

FIG. 1 shows a side elevational view of a frame with superimposed padding devices; and FIG. 2 shows the appratus shown in FIG. 1 in a front elevational view.

Reference numeral 1 designates a frame on which are rotatably mounted two guide rollers 2 and 3 in superimposed relationship, preferably in driven fashion. These rollers are arranged in such a way that the tow 4 of synthetic fibers passing therearound in meander-like arrangement is guided exactly vertically therebetween. On both sides of the tow, between the lower guide roller 2 and the upper guide roller 3, respectively, a padding device 5 and a padding device 6 are located. Each padding device is comprised, respectively, of a trough 7 and a padding roller 8 dipping into the trough. During rotation of the padding rollers 8 in the direction of tow transport in accordance with arrow 9, finishing liquid is stripped off from these rollers onto the tow, guided exactly tangentially along the rollers, which is optionally accomplished based on a possible differential speed between the padding rollers 8 and the tow 4. Since there is a padding device on the left side as well as on the right side, equal amounts of finishing liquid will be stripped off, on both sides of the tow, onto the tow uniformly over the area thereof. According to FIG. 2, a relatively large number of tows 4 is guided over the width of the guide rollers 2, 3. The four tows shown more clearly in FIG. 1, can subsequently be superimposed on one another in total or, respectively, two combined tows for two crimping installations can be provided as well. FIG. 2 shows that the guide rollers 2, 3 are mounted on cantiliver fashion while the padding rollers 8 are supported on both sides. For such support, a special carrying frame 10 is provided for the padding rollers 8.

The guide rollers 2, 3 are driven. The drive mechanism is not illustrated in the drawing. In contrast thereto, the drive means for the two padding rollers 8 can be seen from the drawing. A DC motor 11 which serves for this purpose, is connected via a chain drive 12 to the padding device 6 as well as to the padding device 5. The driving direction shown in the drawing is such that the direction of revolution of the padding rollers is ensured; namely, in the direction of tow transport 9. As shown, the padding roller of the device 5 rotates in the counter-clockwise direction; whereas the padding roller 8 of the device 6 rotates in a clockwise direction. The primary drive for the DC motor 11 is derived, in dependence on the tow transport velocity 9, from the processing unit arranged in front thereof, and transmitted to the drive mechanism 11 via an electrical line. A differential speed can be superimposed at the motor proper by means of a potentiometer arranged therewith.

What is claimed is:

1. An apparatus for finishing endless material which comprises a vertically extending frame, two padding devices arranged in superposition on said frame, each of said padding devices comprising a rotatably supported padding roller immersed in a bath of finishing liquid, said roller transferring the finishing liquid during its revolution to an endless material in contact with the padding roller, and means for guiding the endless material in a stretched condition along a vertical path, said guide means including driven guide rollers, one arranged at the top and one at the bottom of said frame for effecting a meander-shaped guidance of the endless material comprising a synthetic fiber tow, said padding devices being arranged between said guide rollers with one of the padding devices being arranged on one side of the tow and the other padding device being arranged on the other side of the tow whereby both sides of the tow are provided with a uniform application of said finishing liquid.

2. An appratus according to claim 1, wherein the padding rollers and the guide rollers are fashioned of such a width that several tows, which may later on be placed in mutual superposition, can be placed into contact therewith in side-by-side relationship.

3. An apparatus according to claim 1, wherein the padding rollers are connected to each other by way of a drive mechanism common to both rollers.

4. An apparatus according to claim 3, wherein the padding rollers revolve driven in the transport direction of the endless material.

5. An apparatus according to claim 3, wherein the drive velocity of the padding rollers is controlled in dependence on the speed of the endless material.

* * * * *